United States Patent [19]

Yokoyama et al.

[11] Patent Number: 4,609,277

[45] Date of Patent: Sep. 2, 1986

[54] ELECTRO PHOTOGRAPHIC COPIER WITH PHOTOCONDUCTIVE BELT

[75] Inventors: Yoshihiro Yokoyama, Settsu; Yoshito Urata, Katano; Kazuo Watanabe, Nakano; Kiyoteru Ito, Yokohama, all of Japan

[73] Assignee: Matsushita Electric Industrial Co., Ltd., Osaka, Japan

[21] Appl. No.: 683,195

[22] Filed: Dec. 18, 1984

[30] Foreign Application Priority Data

Dec. 19, 1983 [JP] Japan ..... 58-240411

[51] Int. Cl.[4] ..... G03G 15/00

[52] U.S. Cl. ..... 355/3 R; 355/3 BE; 355/3 DD; 355/16

[58] Field of Search ..... 355/3 R, 3 DR, 3 BE, 355/16, 3 FV, 11, 3 SH, 3 DD

[56] References Cited

U.S. PATENT DOCUMENTS

| | | | |
|---|---|---|---|
| 3,997,262 | 12/1976 | Doi et al. | 355/11 |
| 4,365,886 | 12/1982 | Murakami et al. | 355/3 SH |
| 4,378,154 | 3/1983 | Hoffman | 355/16 |
| 4,403,851 | 9/1983 | Yanagawa | 355/3 BE X |
| 4,428,660 | 1/1984 | Matsumoto | 355/3 FU |

FOREIGN PATENT DOCUMENTS

| | | |
|---|---|---|
| 3047706 | 7/1982 | Fed. Rep. of Germany . |
| 3200791 | 9/1982 | Fed. Rep. of Germany . |
| 3301124 | 7/1983 | Fed. Rep. of Germany . |

*Primary Examiner*—A. C. Prescott

*Attorney, Agent, or Firm*—Wenderoth, Lind & Ponack

[57] ABSTRACT

An electrophotographic copier has a photoconductive apparatus including a photoconductive belt and at least first and second rollers around which the photoconductive belt runs, a first body, a development apparatus mounted on the first body and having a support for positioning and supporting the first roller at both ends thereof, and the first body having a single fixing device thereon at a point spaced from the first roller, a second body, and an optical apparatus mounted on the second body, the second body supporting the photoconductive apparatus and having a guide for determining the positions of the first and second rollers, the second body being supported by the single fixing device, whereby the second body is supported substantially at three points on the first body.

4 Claims, 3 Drawing Figures

ELECTRO PHOTOGRAPHIC COPIER WITH PHOTOCONDUCTIVE BELT

BACKGROUND OF THE INVENTION

1. Field of the Invention

The present invention relates to an electrophotographic copier, and more particularly to an electrophotographic copier employing a photoconductive belt as a photoconductive body.

2. Description of the Prior Art

Electrophotographic copiers according to the Carson process (copiers, hereafter) utilize a drum or belt as a photoconductive body. No matter which photoconductive body may be employed, such processing devices as a charger, an exposure device, a transcribing device, a fixing device, a cleaning device, and a paper feeding device are disposed around the photoconductive body.

In copiers employing a drum, it is necessary for miniaturizing the machine body to reduce the diameter of the drum or the sizes of the above processing devices. But, for reducing the drum diameter, there is a technical limit from the view point of the characteristics of the photoconductive belt such as sensitivity to light and span of life. For reducing the processing device sizes, there are a lot of problems to be solved unless epoch-making processing technology would appear.

To overcome the above problems, it would be effective to use a belt as the photoconductive body, because the belt itself could be made compact and the degree of freedom in the arrangement of the above processing devices could be increased. But, actually, it is quite difficult to cause the belt to travel stably without complicated mechanism or parts. So, almost all the copiers now on the market employ a drum; there are few copiers which employ a belt for the purpose of miniaturizing the body size.

SUMMARY OF THE INVENTION

It is an object of the present invention to provide an electrophotographic copier which is of a low profile and capable of achieving high image quality by employing a photoconductive belt.

Another object of the present invention is to provide an electrophotographic copier having a photoconductive apparatus capable of traveling a photoconductive belt without snaking.

To achieve the above objects, an electrophotographic copier according to the present invention comprises: a first body mounting thereon a development apparatus; a second body mounting thereon an optical apparatus; and a photoconductive apparatus having a photoconductive belt and at least first and second roller means for allowing said belt to pass thereon; said second body having guide means for determining positions of said first and second roller means, supporting said photoconductor apparatus, and being substantially supported at three points on said first body. With this arrangement, the photoconductor apparatus is supported on an optical frame (second body) and the second body is supported substantially at the three points, so that even if the machine body (first body) is twisted or distorted, the photoconductive belt can be caused to travel without snaking. Accordingly, high image quality and high reliability can be realized simply by a small-sized copier employing a photoconductive belt.

The above and other objects and features of the present invention will become apparent from the following description taken in connection with the accompanying drawings in which:

DESCRIPTION OF THE PREFERRED EMBODIMENT

Figure 1:
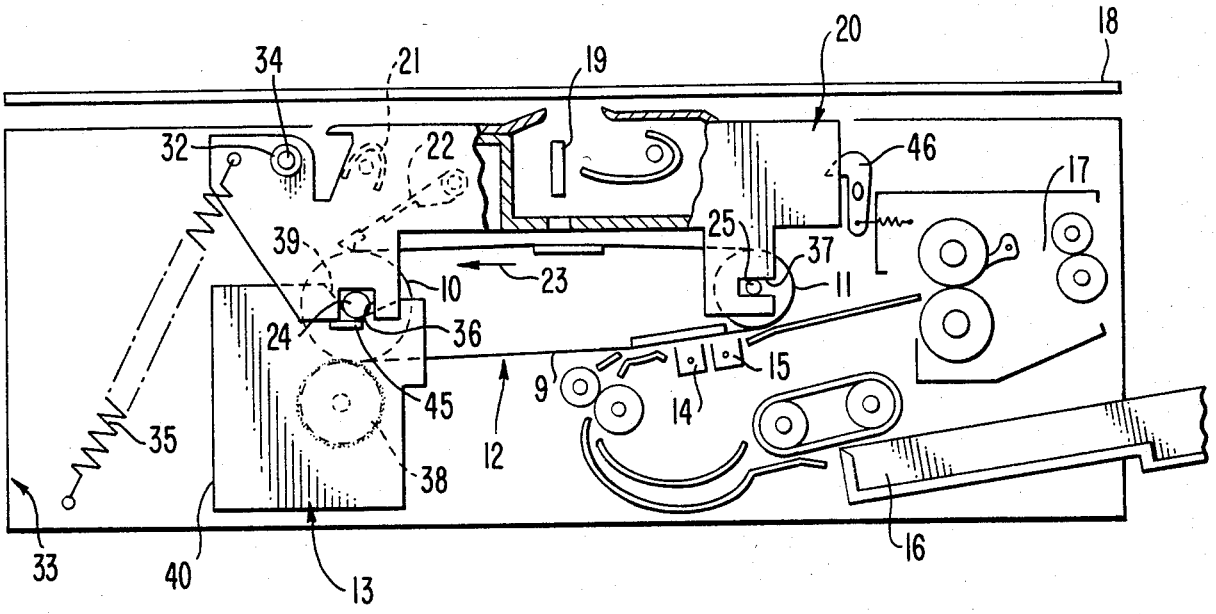
FIG. 1 is a sectional front view of an electrophotographic copier according to the present invention, in a normal copying operation.
Figure 2:
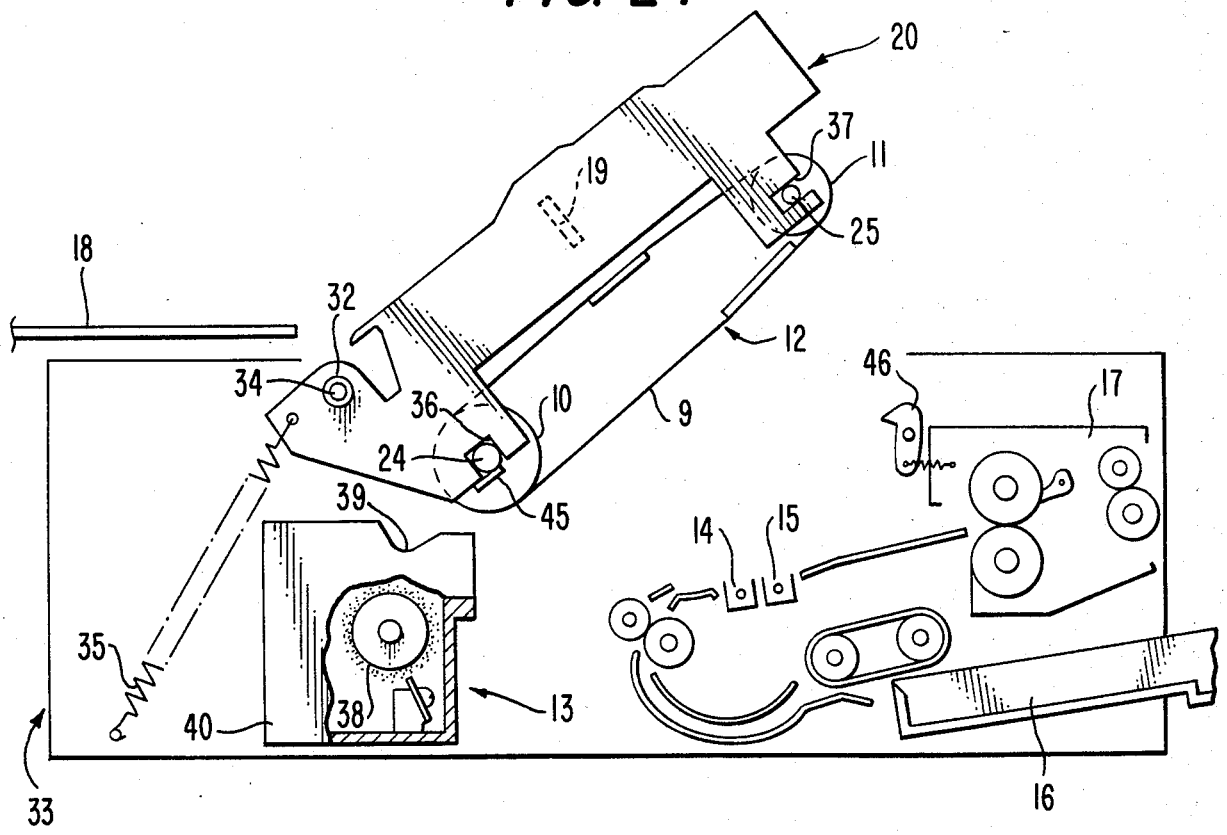
FIG. 2 is a sectional front view of the same electrophotographic copier in a paper jam condition.

Referring to FIG. 1 and FIG. 2, an electrophotographic copier mainly comprises: a photoconductor apparatus 12 which has a photoconductive belt 9 passing over first and second roller means 10, 11 and driven to travel counterclockwise; a development apparatus 13 disposed so as to be facing to the first roller means 10; charging and transfer corotorons 14, 15; a paper feed apparatus 16; a fixing apparatus 17; a reciprocally movable document support 18; an optical frame (second body) 20 on which a fiber lens array 19 is disposed; a discharge lamp 21 and a cleaning blade 22 which are disposed on the optical frame 20. Each process is carried out as the photoconductive belt 9 is driven to travel by the power from a motor (not shown) in the direction of the arrow 23 as illustrated. The constructions and operations of the photoconductor, development, and the optical apparatus 12, 13, 20, which are especially concerned with this invention, will be described hereinbelow. But the detailed description of the copying processes, which are well-known, is omitted.

Figure 3:
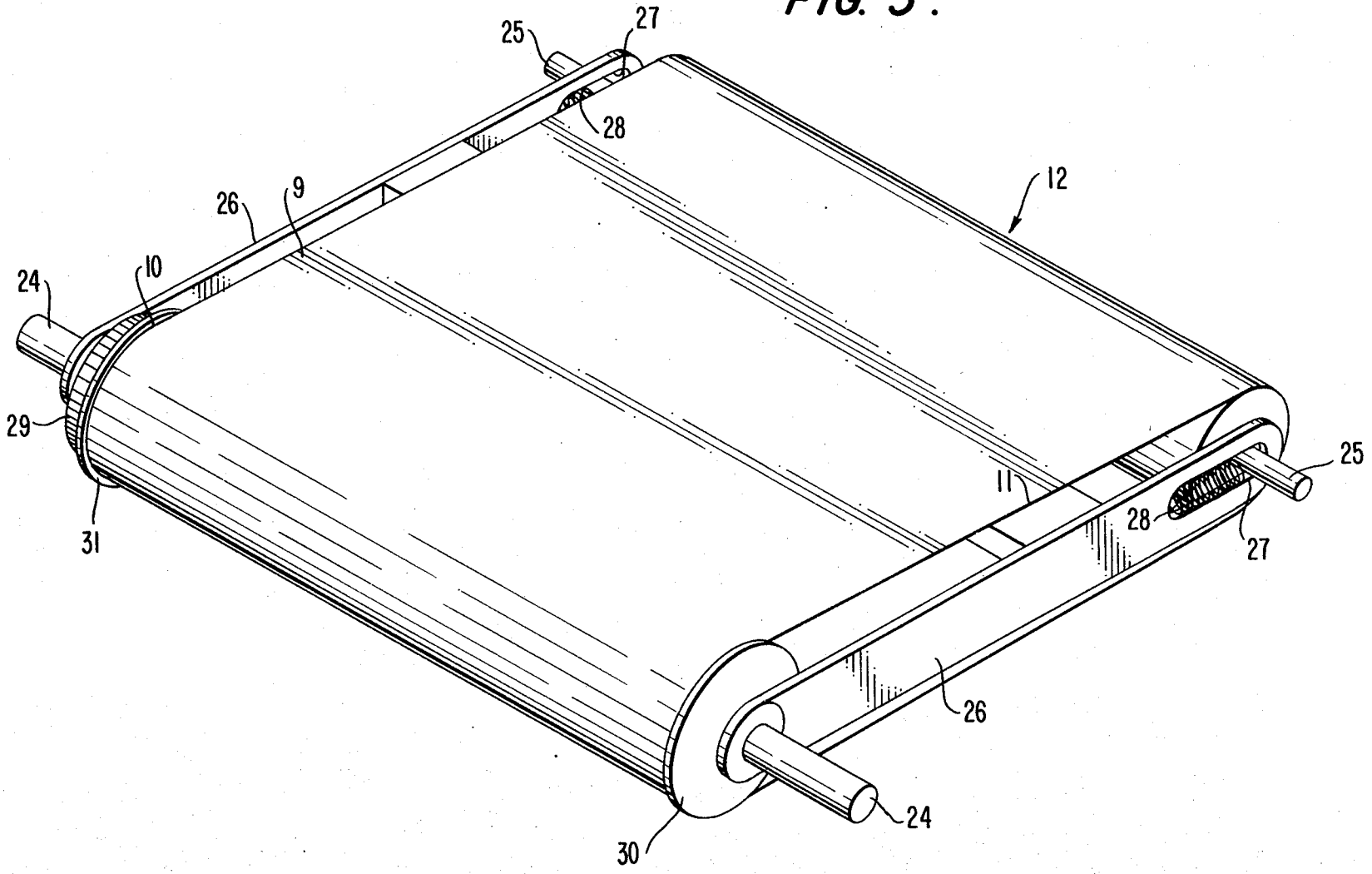
FIG. 3 is a perspective view of a photoconductor apparatus used in the electrophotographic copier of the invention.

Referring to FIG. 3, the first roller means 10 is rotatably mounted on a first shaft 24 which is fixed at both ends to one ends of supporting members 26. In the same manner, the second roller means 11 is rotatably mounted on a second shaft 25 which is movably engaged in slots 27 provided near the other ends of the supporting members 26, and urged by compression springs 28 provided in the slots 27 so as to add a predetermined tension to the photoconductive belt 9. The first and second roller means 10, 11 are driving and driven rollers respectively. The first roller means 10 has at an end a gear 29 which is coupled to a motor (not shown) via a speed reduction mechanism (not shown). Further, the first roller means 10 has at both ends flanges 30, 31 which prevent to some extent the photoconductive belt 9 from snaking when it is traveled.

Next, the snaking of the photoconductive belt 9 will be described briefly. In the embodiment, the photoconductive belt 9 is an endless belt made of a polyester film coated with a photoconductive material. The belt is approximately 100 $\mu$m in thickness, 300 mm in width, and 406 mm in circumference. In order to cause the belt to travel without snaking, various improvements have been introduced. One of the improvements is to make a driving roller in the form of barrel and another is to provide flanges at the both ends of the driving roller. But when the belt has a short circumference for its width like the photoconductive belt 9 in the embodiment and travels at a low speed (approximately 140 mm/sec), it is quite difficult to perfectly prevent the belt from snaking only by the above countermeasures. In this case, it is necessary to improve mechanical accuracy of each components, and further to employ the above flanges supplementarily.

The snaking of the photoconductive belt 9 is influenced largely by:

(1) the accuracy of tortion between the first and second roller means 10, 11;

(2) the irregularity in tension of the photoconductive belt 9;

(3) the machined accuracy of the first and second roller means 10, 11 themselves (the degree of cylinder and so on); and (4) the accuracy in the circumference of the photoconductive belt 9.

Among these factors, the factors (2), (3) and (4) can be solved by improving the accuracies of respective machine parts. However, with regard to the factor (1), the accuracy of tortion is determined by assembling accuracy of the photoconductor apparatus 12, which causes a lot of problems to be solved including cost. In the embodiment, the supporting members 26 which are not so rigid are utilized and the desired accuracy of tortion is obtained by positioning the first and second shafts 24, 25 on the optical frame 20 as described later.

Next, the optical frame 20 will be described. Referring to FIG. 1, the optical frame 20 is movably supported by shafts 34 which are fixed to the machine body 33 and inserted into holes 32 provided at the optical frame 20, and urged counterclockwise by a tension spring 35 which is fixed at an end to the body 33. Accordingly, as shown in FIG. 2, it is possible to pivotally open the optical frame 20 counterclockwise with respect to the shafts 34. This makes it easy to deal with a paper jam. In a normal operation, the optical frame 20 is supported on the machine body 33 by a latch member 46 as shown in FIG. 1.

Also, the optical frame 20 has first grooves (guide means) 36 for fitting thereto the ends of first shaft 24 for positioning the first shaft and second grooves (guide means) 37 for fitting thereto the ends of the second shaft 25. These grooves 36 and 37 are accurately formed so as to secure the tortion accuracy between the first and second shafts 24 and 25. The first shaft 24 is locked by a stopper member 45. By unlocking the stopper member 45, the photoconductor apparatus 12 can be dismounted from the optical frame 20. The development apparatus 13, which is disposed on the machine body 33, has a developing roller 38 disposed oppositely to the first roller means 10 and supporting members 40 for supporting the first shaft 24. The supporting members 40 have V-shaped grooves 39 respectively for positioning and supporting the first shaft 24 at the both ends. The position accuracy of the V-shaped groove 39 with respect to the developing roller 38 is very important because the accuracy of the gap between the first roller means 10 and the developing roller 38 largely affects copy quality. On the other hand, as shown in FIGS. 1 and 2 the diameter of the holes 32 of the optical frame 20 is made larger than that of the shaft 34, so that the first roller means 10 is positioned exactly on the development apparatus 13 by the urging force of the tension springs 35 when the latch member 46 locks the optical frame 20.

From the above description the following will become clear. The optical frame 20 (second body) and the photoconductor apparatus 12 are substantially supported at three points on the machine body 33 (first body). The three points are: the point locked by the latch member 46; and the contact points of the both ends of the shaft 24 and the V-shaped groove 39 of the supporting members 40. Accordingly, the accuracy of the optical frame 20 can be obtained even if the machine body 33 is distorted or twisted. Thus, it is possible to cause the photoconductive belt 9 to travel stably.

Furthermore, since the first shaft 24 is supported by the supporting members 26 disposed on the development apparatus 13, a stable developing condition can be obtained. Needless to say, since the development apparatus 13 is fixedly mounted on the machine body 33, to support the optical frame 20 on the developing apparatus 13 means to support the same on the machine body 33.

In the above embodiment, the optical frame 20 is turnably mounted on the machine body 33 so as to deal with a paper jam easily, but this is not always necessary.

What is claimed is:

1. An electrophotographic copier comprising:

a photoconductive apparatus including a photoconductive belt and at least first and second roller means around which said photoconductive belt runs;

a first body;

a development apparatus mounted on said first body and having a supporting means for positioning and supporting said first roller means at both ends thereof, and said first body having a single fixing means thereon at a point spaced from said first roller means;

a second body; and an optical apparatus mounted on said second body, said second body supporting said photoconductive apparatus and having guide means for determining the positions of said first and second roller means, said second body being supported by said single fixing means, whereby said second body is supported substantially at three points on said first body.

2. The electrophotographic copier according to claim 1, wherein said first and second roller means have a first and a second shaft respectively which are substantially not rotatable, said guide means positioning said first and second shafts, and said supporting means supporting said first shaft.

3. The electrophotographic copier according to claim 1, wherein said second body is movable with respect to said development apparatus and has urging means for pressing said first roller means against said supporting means, whereby said second body, said photoconductor apparatus, and said development apparatus are positioned in desired positions with respect to each other.

4. The electrophotographic copier according to claim 3, wherein said first and second roller means have a first and a second shaft respectively which are substantially not rotatable, said guide means positioning said first and second shafts, and said supporting means supporting said first shaft.

* * * * *